US005244271A

United States Patent [19]

Hackwood et al.

[11] Patent Number: 5,244,271

[45] Date of Patent: Sep. 14, 1993

[54] SELF-ASSEMBLY FURNITURE SYSTEM

[75] Inventors: Mark Hackwood, London, England; Gideon Karmon, Kibbutz Gadot, Israel; Jakob Adorian, Kibbutz Gadot, Israel; Yavetz Tal, Kibbutz Gadot, Israel; Moshe Leczycki, Tel Aviv, Israel

[73] Assignee: Plasgad Plastic Products, Mobile Post Hevel Korazim, Israel

[21] Appl. No.: 574,691

[22] Filed: Aug. 29, 1990

[30] Foreign Application Priority Data

Sep. 8, 1989 [IL] Israel ..... 91583

[51] Int. Cl.[5] ..... A47B 13/08; A47B 3/06

[52] U.S. Cl. ..... 312/313; 312/257.1; 108/156; 297/440.15

[58] Field of Search ..... 297/440; 108/1, 157, 108/158, 156, 159, 902; 248/188; 312/256, 257, 313

[56] References Cited

U.S. PATENT DOCUMENTS

| | | | |
|---|---|---|---|
| 2,473,862 | 6/1949 | Clawsey | 312/228 |
| 2,522,322 | 9/1950 | Wallace | 312/256 X |
| 3,687,092 | 8/1972 | Manning | 108/156 |
| 3,730,109 | 5/1973 | Kreizel et al. | 108/156 |
| 3,850,117 | 11/1974 | Martinelli | 108/159 X |
| 4,394,563 | 7/1983 | Schnell | 248/188 X |
| 4,691,965 | 9/1987 | Hsiung | 297/440 |
| 4,842,350 | 6/1989 | Collings | 312/228 |
| 4,890,735 | 1/1990 | Fukumoto . | |
| 5,002,247 | 3/1991 | Dispenza et al. | 248/188 |

FOREIGN PATENT DOCUMENTS

| | | |
|---|---|---|
| 1162983 | 3/1959 | Fed. Rep. of Germany . |
| 1271927 | 11/1960 | Fed. Rep. of Germany . |
| 2060999 | 3/1970 | Fed. Rep. of Germany . |
| 2310109 | 1/1976 | France . |
| 63-199140 | 8/1988 | Japan . |
| 6915326 | 7/1969 | Netherlands . |
| 1367196 | 6/1971 | United Kingdom . |

OTHER PUBLICATIONS

"Little Tykes"-Brochure (2 pages) undated.

"Wader-Spielen and Erleben"-Brochure (11 pages) none.

*Primary Examiner*—Peter R. Brown

*Attorney, Agent, or Firm*—Ladas & Parry

[57] ABSTRACT

A self-assembly furniture system including a self-assembly table comprising a generally planar table element defining a plurality of first mating portions; and a plurality of legs arranged to support the table element, each of the legs defining a second mating portion configured to lockably engage a selected one of the plurality of first mating portions so as to define therewith a self-locking joint arranged to prevent substantial relative movement between the first and second mating portions.

27 Claims, 10 Drawing Sheets

SELF-ASSEMBLY FURNITURE SYSTEM

FIELD OF THE INVENTION

The present invention relates to furniture in general, and, in particular, to self-assembly recreational furniture intended for use by children.

BACKGROUND OF THE INVENTION

Many different types of children's furniture are available in the market. Disclosed in U.S. Pat. No. 4,682,827 to Woodward is a combination toy box and drafting table. The combination box and table has a box portion defining a storage space and includes a pair of parallel wooden bars attached at both ends to the sides of the box portion so as to be spaced diagonally from each other, and such that a planar cover of the box portion may be supported at an angle so as to be suitable for use a s drafting surface.

A disadvantage of the above-described toy box and table to Woodward is that the means for supporting the cover comprises a pair of bars that serve to limit the usable space within the box portion.

Manufactured by LITTLE TIKES, of Hudson, Ohio 44236, U.S.A., are various items of children's furniture, including a desk, which bears a similarity to conventional student desks, wherein a boxlike storage space is covered with a generally planar cover, attached at one edge to a portion of the desk, generally by means of a hinge.

Marketed by SASSY (trademark), of 1534 College S.E., Grand Rapids, Mich. 49507, U.S.A., is a non-watertight wooden desk that has a removable cover having a bar that permits its to be placed within a space defined by the desk so as to be used as an easel. Placement of the cover for use as an easel is most effectively achieved from the rear of the desk, rendering it rather a cumbersome operation.

Furthermore, the contact surfaces of the table portions and the bolt heads are smooth, and the bolt heads define a groove so as to facilitate turning of the bolts. A disadvantage of these connections is, therefore, that the bolts are relatively easy to undo, even by a child, with a normal screwdriver or a coin or other suitable implement.

Manufactured by L.M. LIPSKI Ltd., P.O.B. 2111, Herzlia, 46120, Israel, is a plastic children's chair having side supports attached to seat and back rest portions with plastic bolts. A characteristic of this chair, similar to a characteristic if the desk made by Sassy, is that the contact surfaces of the chair portions and the bolt heads are smooth, and the bolt heads define a groove so as to facilitate turning of the bolts. A disadvantage of these connections is, therefore, that the bolts are relatively easy to undo, even by a child, with a normal screwdriver or a coin or other suitable implement.

Available from Wader GmbH, West Germany, is a self-assembly plastic chair. The various portions of the chair are assembled by means of screws arranged to be screwed directly into the plastic of the chair. A disadvantage of this form of connection is that the screw threads may be worn away through repeated use of the chair, thereby causing the chair to become unstable.

SUMMARY OF THE INVENTION

The present invention seeks to provide self-assembly, multipurpose, recreational furniture overcoming disadvantages of known art. In particular, it is an aim of the present invention to provide a table and chair set for use by children, having joints that, while being relatively easy to construct, are particularly secure and child proof.

A further aim of the present invention is to provide a multipurpose table, serving as a storage and play container, and having multiple position work surfaces.

There is provided, therefore, in accordance with an embodiment of the invention, a self-assembly furniture system including a self-assembly table comprising a generally planar table element defining a plurality of first mating portions; and a plurality of legs arranged to support the table element, each of the legs defining a second mating portion configured to lockably engage a selected one of the plurality of first mating portions so as to define therewith a self-locking joint arranged to prevent substantial relative movement between the first and second mating portions.

Additionally in accordance with an embodiment of the invention, the first mating portion has a socket configuration and includes integrally formed first resilient engagement apparatus, and the second mating portion is arranged for tight insertion into the first mating portion and includes integrally formed second resilient engagement apparatus arranged to be lockable engaged by the first engagement apparatus when the second mating portion is inserted into the first mating portion.

Further in accordance with an embodiment of the invention, the first and second mating portions define respective first and second apertures arranged along a common axis when the first and second mating portions are locked together, the table also including additional apparatus for fastening together the first and second mating portions, the additional apparatus comprising an elongate first fastening element arranged to extend axially through the first and second apertures and a second fastening element arranged to be fastened together with the first fastening element so as to secure therebetween the first and second mating portions.

Additionally in accordance with an embodiment of the invention, the self-assembly furniture system also includes a self-assembly chair comprising a seat member having a plurality of first apertures; a pair of side members having a plurality of second apertures and arranged to support the seat member in a predetermined position relative thereto such that each of the first plurality of first apertures is secured in registration with a predetermined one of the plurality of second apertures along a common axis; and apparatus for fastening the pair of side members together with the seat member so as to lock the seat member in the predetermined relative position, the apparatus for fastening including a plurality of elongate first fastening elements, each being arranged to extend axially through a selected pair of corresponding first and second apertures, a plurality of second fastening elements, each being arranged to be fastened together with a selected first fastening element so as to lockably secure therebetween predetermined portions of the side members and the seat member in the predetermined position and thereby define a plurality of joints, the first and second fastening elements being arranged for engagement over a first load bearing area substantially perpendicular to the common axis and the first and second fastening elements and the predetermined portions of the side members and the seat member being arranged for engagement, at each of the plurality of joints, over a second load bearing area substantially at right angles to the common axis, the second load bearing area being of greater magnitude than the first load bearing area.

Further in accordance with an embodiment of the invention, the self-assembly furniture system also includes a back member defining a plurality of third apertures, the pair of side members being further arranged to support the back member in a predetermined position, transverse to the seat member, and such that each of the third apertures is arranged in registration with a predetermined one of the second apertures of the side members; each of a further plurality of the elongate first fastening elements being arranged to extend axially through a selected pair of corresponding second and third apertures, and each of a further plurality of second fastening elements being arranged to be fastened together with a selected first fastening element so as to lockably secure therebetween predetermined portions of the side members and the back member in the predetermined position relative to the seat member and thereby define a further plurality of joints, the first and second fastening elements being arranged for engagement over a first load bearing area substantially perpendicular to the common axis and the first and second fastening elements and the predetermined portions of the side members and the back member being arranged for engagement, at each of the plurality of joints, over a second load bearing area substantially at right angles to the common axis, the second load bearing area being of greater magnitude than the first load bearing area.

BRIEF DESCRIPTION OF THE DRAWINGS

The present invention will be understood and appreciated more fully from the detailed description, taken in conjunction with the drawings, in which.

DETAILED DESCRIPTION OF THE INVENTION

Figure 1:
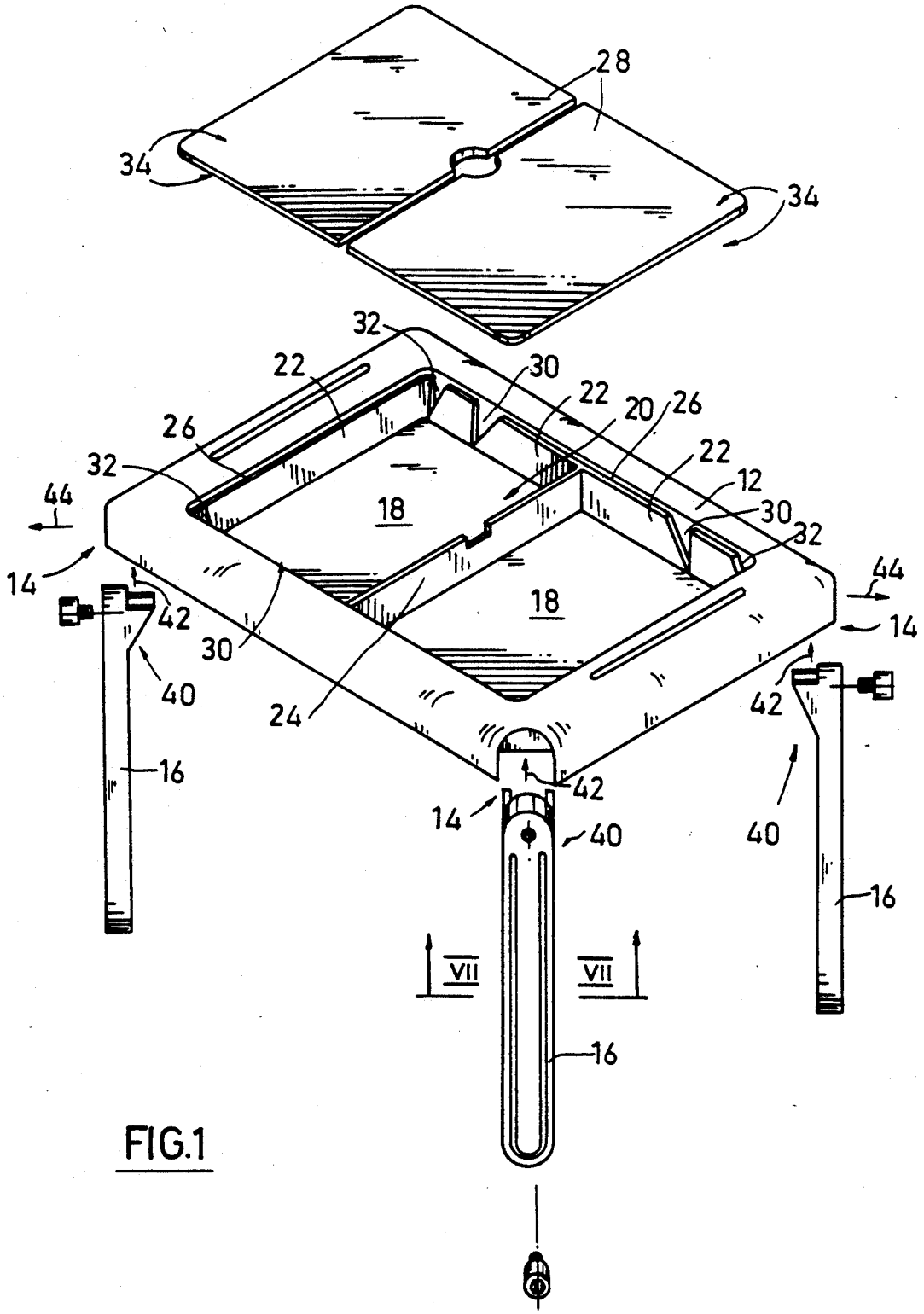
FIG. 1 is an exploded view of a table, constructed in accordance with an embodiment of the invention.

Reference is made to FIG. 1, in which there is shown an exploded view of a table, referenced generally 10, constructed in accordance with an embodiment of the invention. Table 10 is typically intended for self-assembly and forms part of a children's recreational furniture set, which also includes one or more chairs constructed according to either of the embodiments as illustrated in FIGS. 8A to 9B. The chairs are described below in conjunction with the corresponding drawings.

As will become apparent from the ensuing description, a particular aim of the invention is to provide self-assembly furniture, namely, a table and chairs, that is not only easy to assemble, but that is not substantially less secure than non-self-assembly furniture, whose joints are constructed in the factory. The joints are discussed in detail below in conjunction with FIGS. 4A to 6B.

Accordingly, legs 16 are typically arranged at approximately 45 degrees to the edges of a generally planar, typically rectangular table element 12. As will be appreciated by persons skilled in the art, this arrangement of the legs with respect to the table element provides maximum stability of the table.

Table element 12 which, as described below, has a number of different functions, defines mounting locations 14 at each of its corners, whereat it is mounted onto table legs 16. The joint of each leg 16 to the element 12 is constructed so as to be particularly stable, and so as to be resistant to being loosened, either simply through use of the table or by a child.

Table element 12 defines, in the shown embodiment, a pair of compartments 18, having a common base 20 and generally perpendicular side walls 22 and separated by a barrier 24. Each compartment 18 is watertight and may, therefore, be used for activities involving water or other liquids. Accordingly, the work unit is conveniently made of plastic, typically taken from either of the groups ABS or polypropylene, by an injection molding technique.

Figure 2:
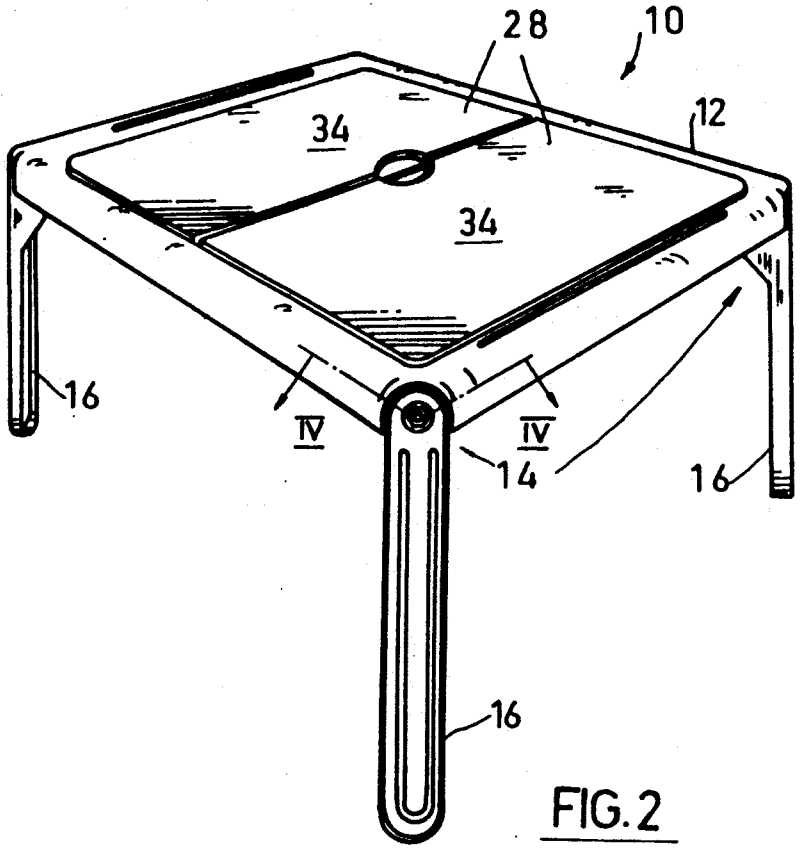
FIG. 2 is an isometric view of the table of FIG. 1, in a closed position.

Side walls 22 of the element 12 define a ridge 26, which supports generally planar cover members 28 placed thereon in a position generally parallel to the base 20 so as to cover the individual compartments, as shown in FIG. 2. Provision of the cover members permits normal use of the table, while covering any items, such as children's toys or games, that may be conveniently stored within the compartments. As preferably each compartment has its own cover member, each compartment may be used totally independently from the other.

Figure 3:
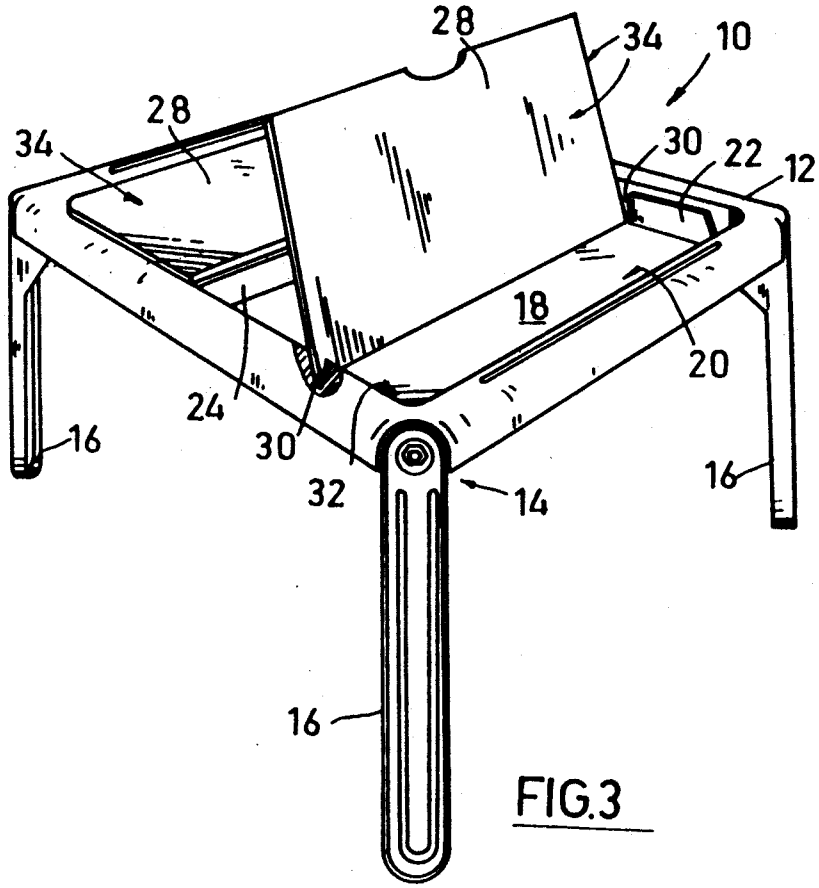
FIG. 3 is a further isometric view of the table of FIG. 1, wherein a cover member thereof is in an easel-type position.

This independent use of the two compartments is illustrated in FIG. 3. As shown, one of the cover members 28 has been left in place covering a compartment, while the other cover member is supported in a semi-upright position by notches 30 integrally formed in side walls 22, thereby permitting the cover member to be used as an easel or inclined drafting surface. Generally, in each of the compartments there are provided at least two pairs of opposing integral notches, referenced 30 and 32, each pair of notches supporting a cover member 28 at a predetermined angle to the base. Typically, notches 30 and 32 are arranged to support cover member 28 at respective inclinations to the base of approximately 60 and 45 degrees.

Cover members 28 may be made of any suitably rigid material on which it is known to provide laminated surfaces. The surface provided is dictated by the intended use of any of the surfaces 34 of the cover members. Thus, any of surfaces 34 may be formed as a blackboard, a white board, or a magnetic board. Alternatively, the surface may be provided with a simple, aesthetic finish.

A particular advantage of the provision of notches 30 and 32 to support the cover members is that when the cover members are not in use in a semi-upright position, the presence of the notches does not interfere with the use of the compartments, nor do the notches impede cleaning of the compartments, unlike transverse bar supports as known in the art and described hereinabove in the background. Also the provision of the above-described integral notches permits easel-type use of the cover, as described, while not requiring the provision of additional support members, thus constituting a saving in terms of the number of parts of the table of the invention.

Furthermore, the notch supports ensure that, as opposed to a hinged lid, such as found, for example, in conventional student desks, if the cover member were to slip, a child located next to the table would almost certainly not be injured by the cover falling on his fingers.

Reference is now made to FIGS. 4A to 6B, in which are shown details of a table leg joint and fastener elements used therein, in accordance with an embodiment of the invention.

Figure 4A:
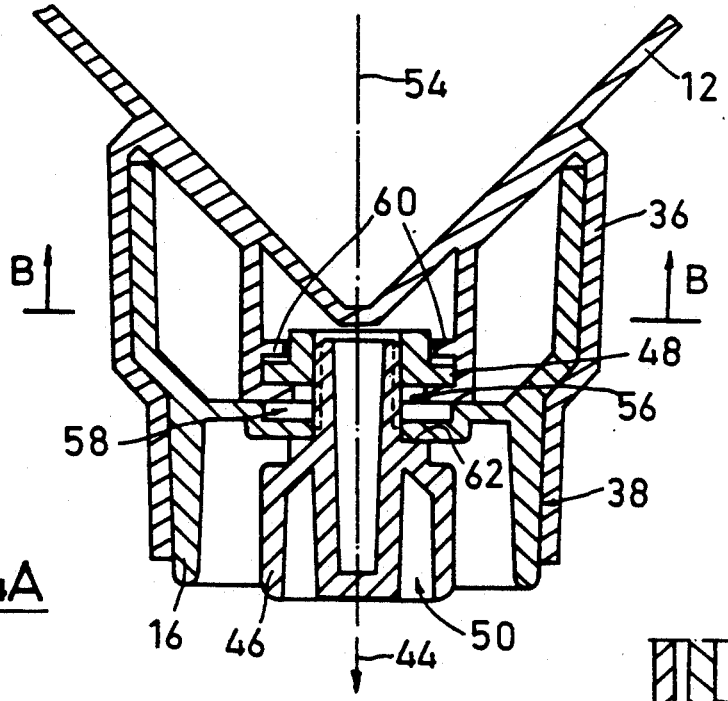
FIG. 4A is a sectional view of a joint of the table shown in FIG. 2, taken along line IV—IV therein.

With particular reference to FIGS. 1 and 4A, each of mounting locations 14 has a socket-like configuration defining, as shown in FIG. 4A, a relatively wide inner portion 36 and a narrower outer portion 38. The upper portion 40 of each table leg 16 is configured to fit tightly within mounting portion 14.

Entry of portion 40 into mounting location 14 is from beneath element 12, as indicated by arrows 42 (FIGS. 1 and 4B), so that once leg portion 40 is engaged with a mounting location 14, the narrower outer portion 38 of the mounting provides resistance to removal of the leg portion from the mounting location in a direction shown by arrows 44 (FIGS. 1 and 4) transverse to arrows 42.

Figure 4B:
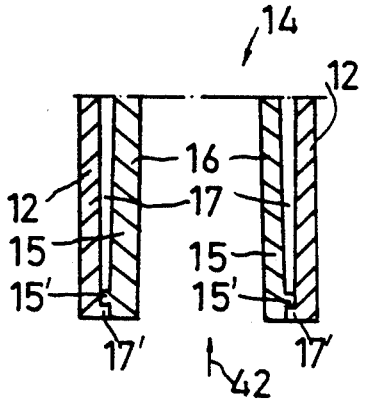
FIG. 4B is a view taken along line B—B in FIG. 4A.

As shown in FIG. 4B, respective pairs of facing surfaces 15 and 17 of each leg 16 and each mounting location 14, define respective opposing first and second pairs of ribs 15' and 17'. As the upper portion 40 of leg 16 is inserted into mounting location 14, first ribs 15' are engaged by second ribs 17', and an additional force is required to be exerted on leg 16 in the direction of arrow 42, so as to snap the upper portion 40 of the leg, into a predetermined position within the mounting location. This snap-type of construction ensures that leg 16 is secured against movement in a direction opposite to arrow 42, in addition to the securing of the leg against movement transverse to arrow 42, as described above.

It will thus be appreciated that a safe and relatively stable self-locking joint is defined by the upper portion of each leg and its selected mounting location, so as to lock together the leg and the table element against substantial relative movement therebetween.

Shown in FIGS. 4A and 5A–6B is additional fastening apparatus comprising a screw 46 and a nut 48, preferably made of a plastic, such as Nylon 66. A particular feature of screw 46 is its head, in which there is formed a groove 50, shown here to be hexagonal. This grooved type of configuration, it will be appreciated, renders the screw particularly difficult to open once it has been tightened unless a key or wrench 52 having a configuration, as shown, corresponding to that of the groove, is employed.

It is envisaged that table 10 of the invention will be assembled by an adult, and that after assembly, the adult will place the key 52 out of reach of a child, so that the child will be unable to open the screw 46.

A further particular feature of the invention is the screw itself. Although screws having a head defining a multiple engagement-surface socket are known, such as Allen screws, a problem of these screws is that a key used to open or close them, in this example, and Allen key, may be worn down relatively quickly. The provision of a groove, however, in place of a simple socket, provides double the number of engagement surfaces, thereby reducing the rate at which the key is worn down and ensuring greater durability of the key.

Figure 5A:
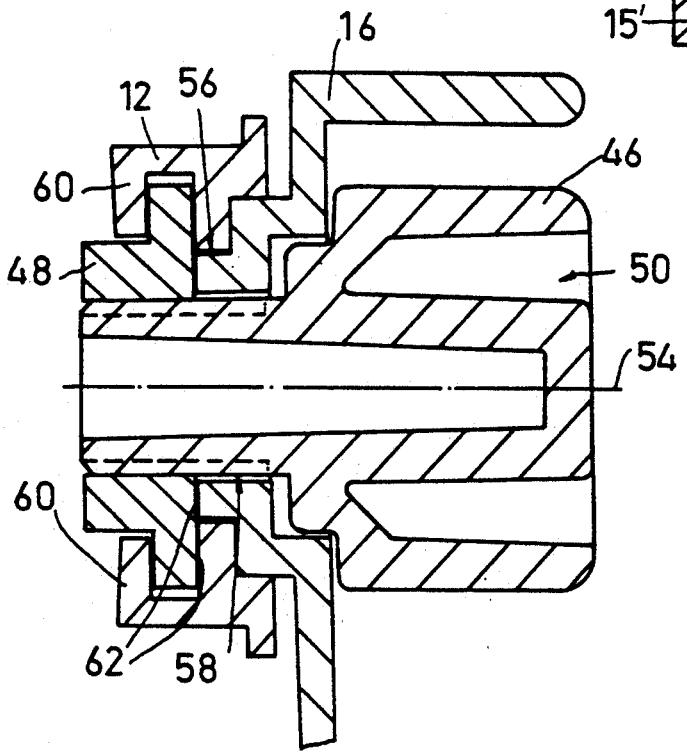
FIG. 5A is a further sectional view of a portion of the joint shown in FIG. 4A, taken at right angles thereto, but wherein the joint is not fully assembled.
Figure 5B:
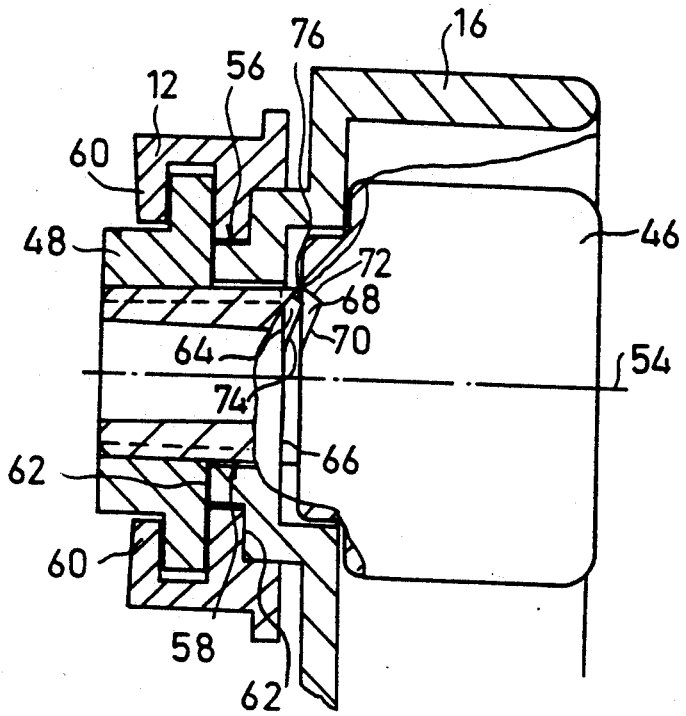
FIG. 5B is a partial elevation of the joint shown in FIG. 4A, corresponding to the view shown in FIG. 5A.
Figure 6A:
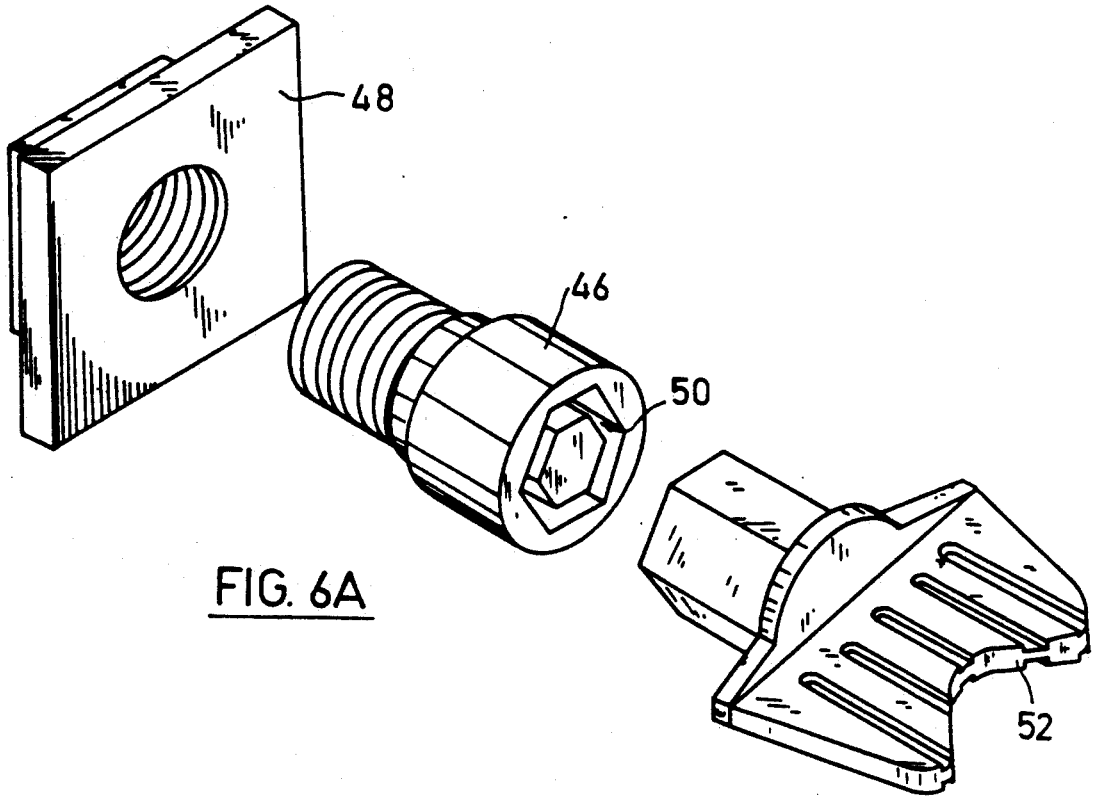
FIG. 6A is an exploded view of fastener elements used in the joint of FIGS. 4A, 5A and 5B.
Figure 6B:
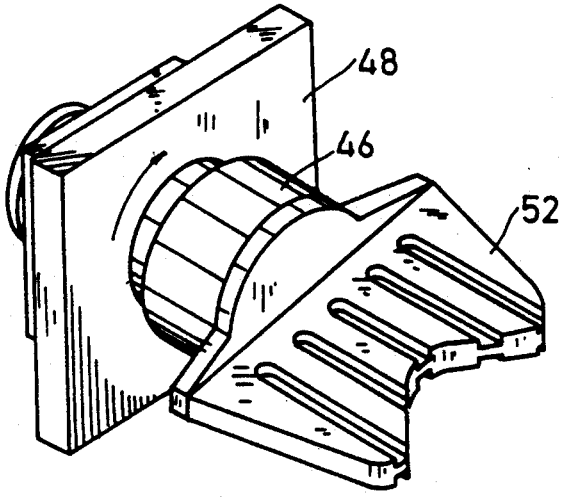
FIG. 6B is an isometric view of the fastener elements shown in FIG. 6B, shown in a partially assembled position.

Referring more particularly to FIGS. 4A, 5A and 5B, screw 46 is arranged to extend along an axis 54, and through respective openings 56 and 58 formed in leg 15 and table element 12 so as to screwably engage nut 48 housed within flange portions 60 of element 12, formed about axis 54. As shown, however, the common engagement surfaces between screw 46 and leg 16, and leg 16 and element 12, rather than being smooth, have a stepped configuration.

As will be appreciated by persons skilled in the art, this stepped configuration ensures that while any load applied to the joint along axis 54 is taken up partly by the screw thread, as with most conventional joints, most of the force is spread over joint surfaces 62 arranged substantially at right angles to axis 54, serving to greatly reduce the stress on the screw thread and thus reduce wear thereon.

With further reference to FIG. 5B, there is shown further apparatus for preventing the loosening of the joint of the present invention. This apparatus comprises typically one or more tooth-like protrusions 64, formed on an outward facing recessed surface 66 of leg 16, arranged to engage one or more recesses 68, formed on a corresponding surface of screw 46. Preferably, a single protrusion 64 is provided, while there are provided several recesses 68, although only one is visible in the view of FIG. 5B.

According to other embodiments of the invention, a plurality of protrusions and a single recess may be provided, and the respective locations of the protrusion and the recesses may be changed over.

As shown, protrusion 64 and recesses 68 have similar configurations, so that when completely engaged, respective first and second surfaces 70 and 72 of the recesses completely overlay the respective corresponding first and second surfaces 74 and 76 of the protrusion. In order to provide a relatively low resistance to tightening of the screw and to provide relatively high resistance to opening of the screw, first surfaces 70 and 74, which are arranged to move against each other when the screw is being tightened, are formed to have a relatively small angle of slope. The second surfaces 72 and 76, however, which are arranged to move against move against each other when the screw is being opened, are formed to have a relatively large angle of slope.

Figure 7:
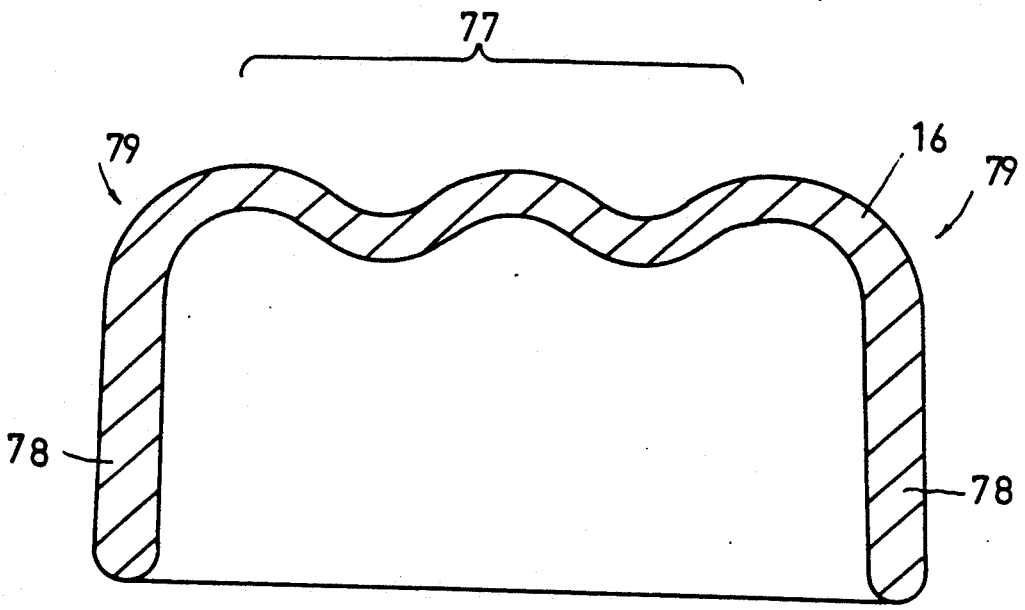
FIG. 7 is a cross-section of a table leg shown in FIG. 1 and of a leg portion of a side support member of a chair, as shown in FIG. 8A, taken along line VII—VII in FIGS. 1 and 8A.

Referring now briefly to FIG. 7, there is shown a cross-section of table leg 16 of table 10, formed according to an embodiment of the invention. As shown, rather than having a more conventional square, circular or U-shaped cross-sectional configuration, a central portion 77 of leg 16 has a sinusoidal wavelike configuration, terminating in generally linear flange portions 78. The thickness of the leg 16 is shown to vary at transition portion 79. This configuration was selected by the present Inventor to provide a relatively strong leg element while reducing material wastage found in more conventional configurations.

The wavelike configuration described above with reference to legs 16 of the table of the invention, is also provided to leg portions 92 of side support members 86 of chairs described below in conjunction with FIGS. 8A to 9B. It is indicated in FIG. 8A by line VII—VII, although it is not limited to the particular type of chair shown.

Figure 8A:
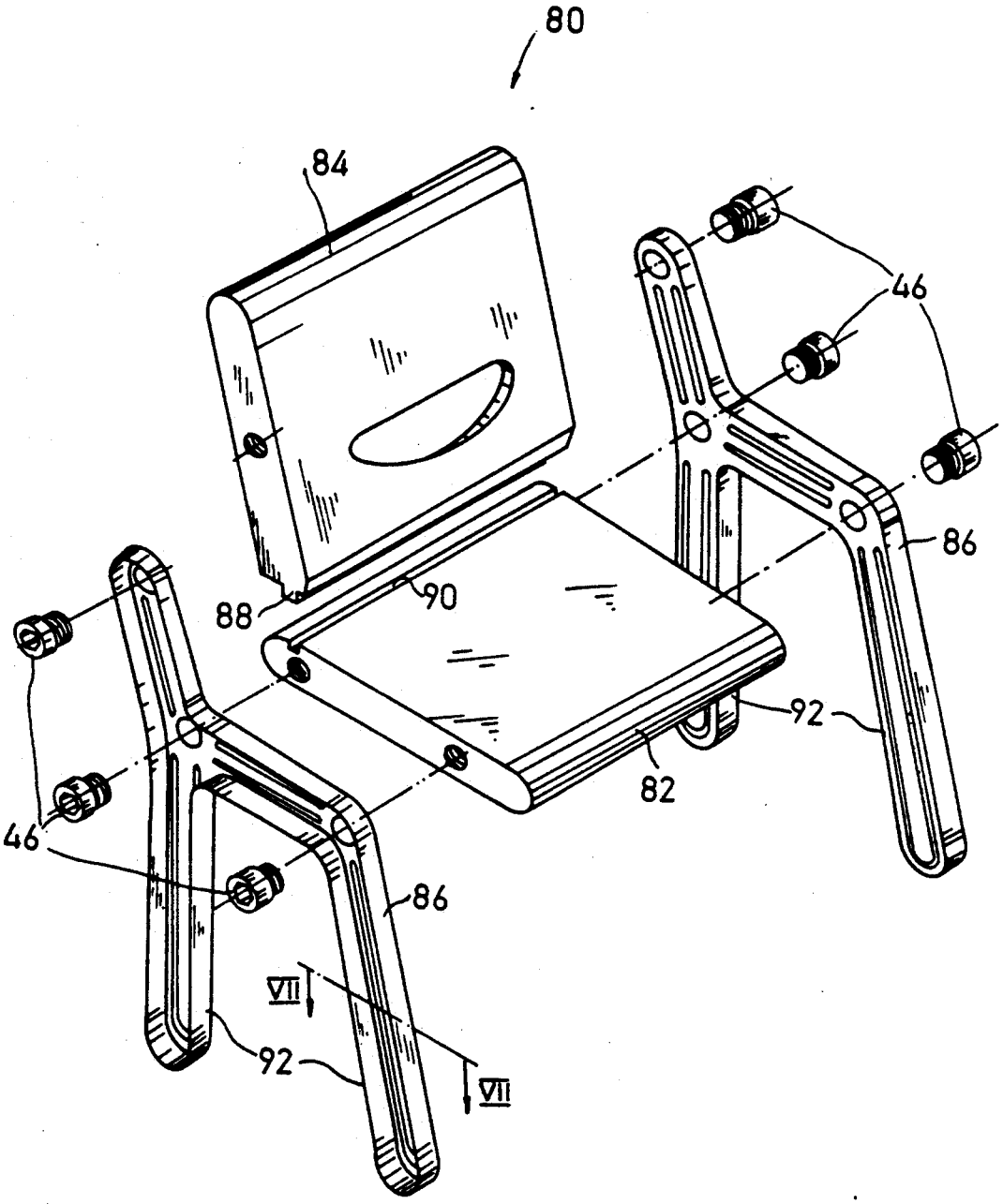
FIG. 8A is an exploded view of a chair constructed according to one embodiment of the invention.
Figure 8B:
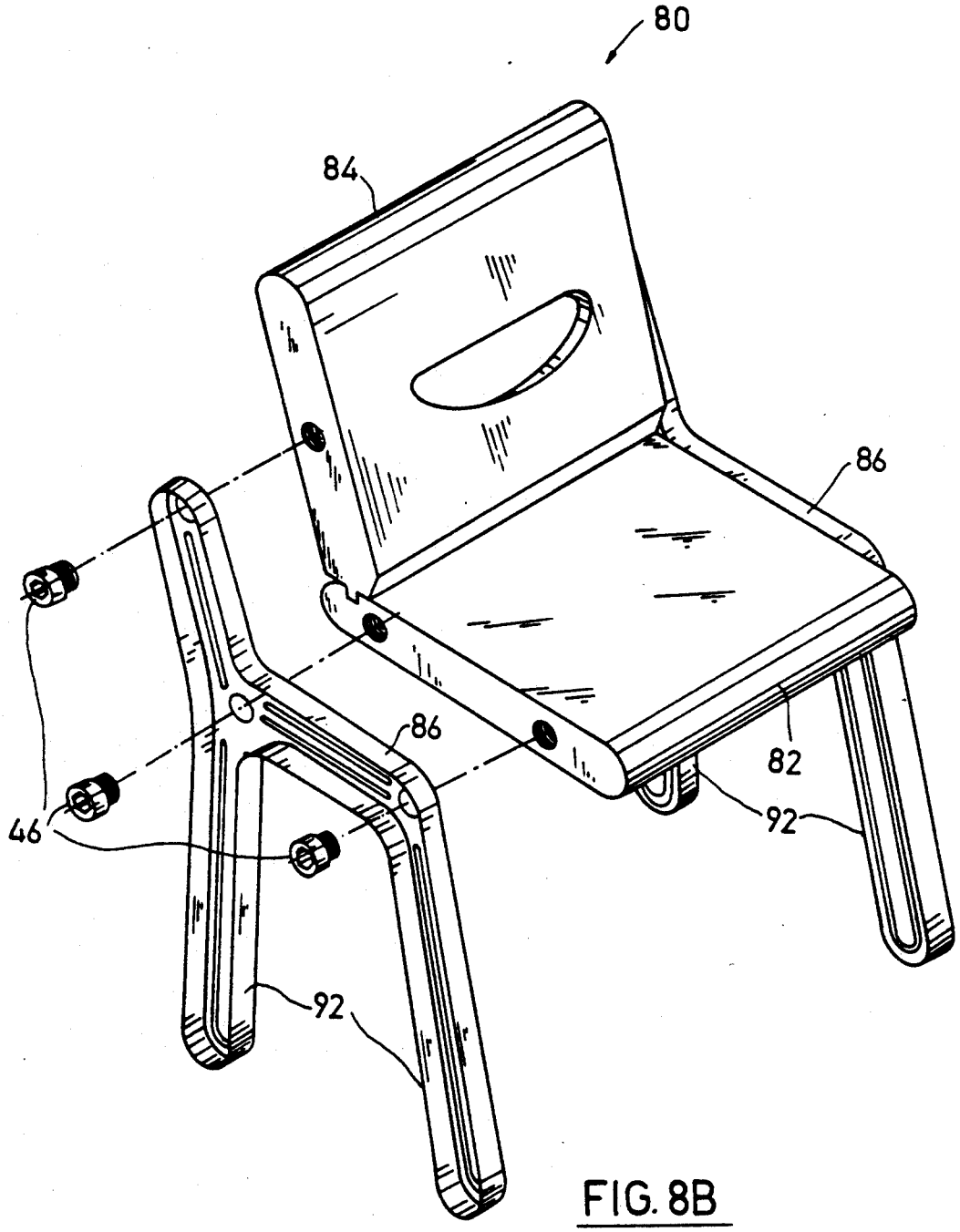
FIG. 8B is a view of the chair of FIG. 8A in a partially assembled state.
Figure 8C:
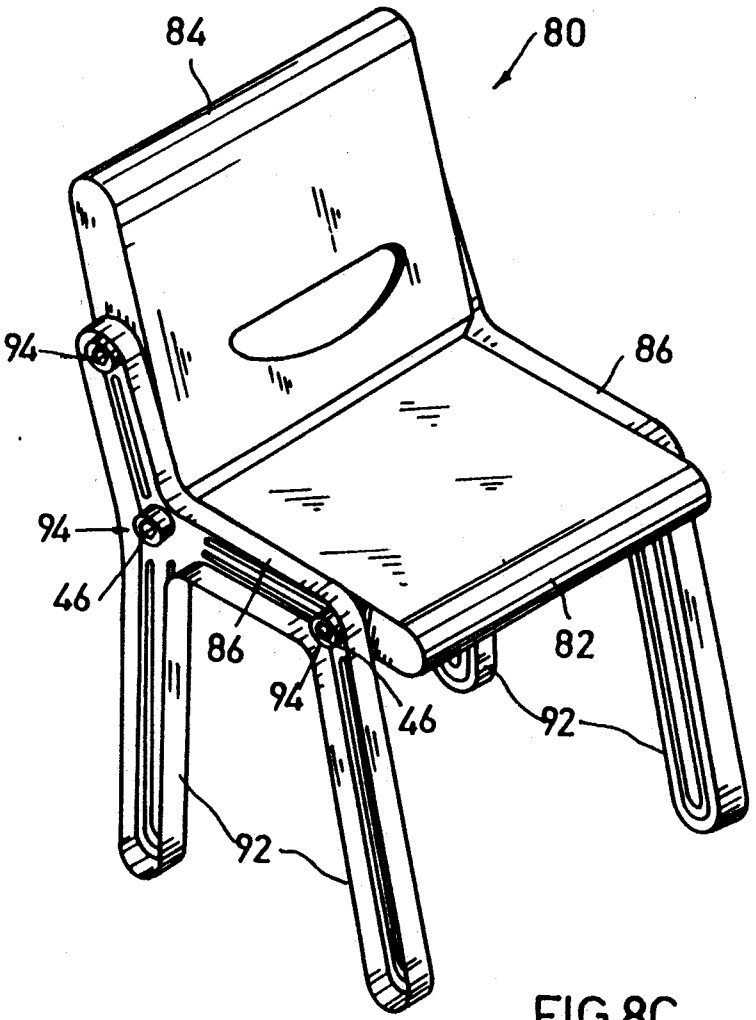
FIG. 8C is a view of the chair of FIG. 8A in a fully assembled state.

FIGS. 8A to 8C show various stages in the assembly of a chair, reference generally 80, constructed according to an embodiment of the invention. Also according to an embodiment of the invention, chair 80 is intended for use in combination with table 10 (FIG. 1).

Chair 80 comprises a seat 82, a back 84 and side supports 86. An edge of back 84 defines a ridge 88 (FIG. 8A) which is arranged for engagement with a groove 90 formed in a rear portion of seat 82. Side supports 86 define leg portions 92 and also constitute a support framework for the seat and back. The side supports are typically connected to the seat and back by joints 94. These joints utilize screws 46 and nuts 48, and have a construction similar to that of the joints shown in FIGS. 5A and 5B. Joints 94 are, therefore, not described in detail herein.

Figure 9B:
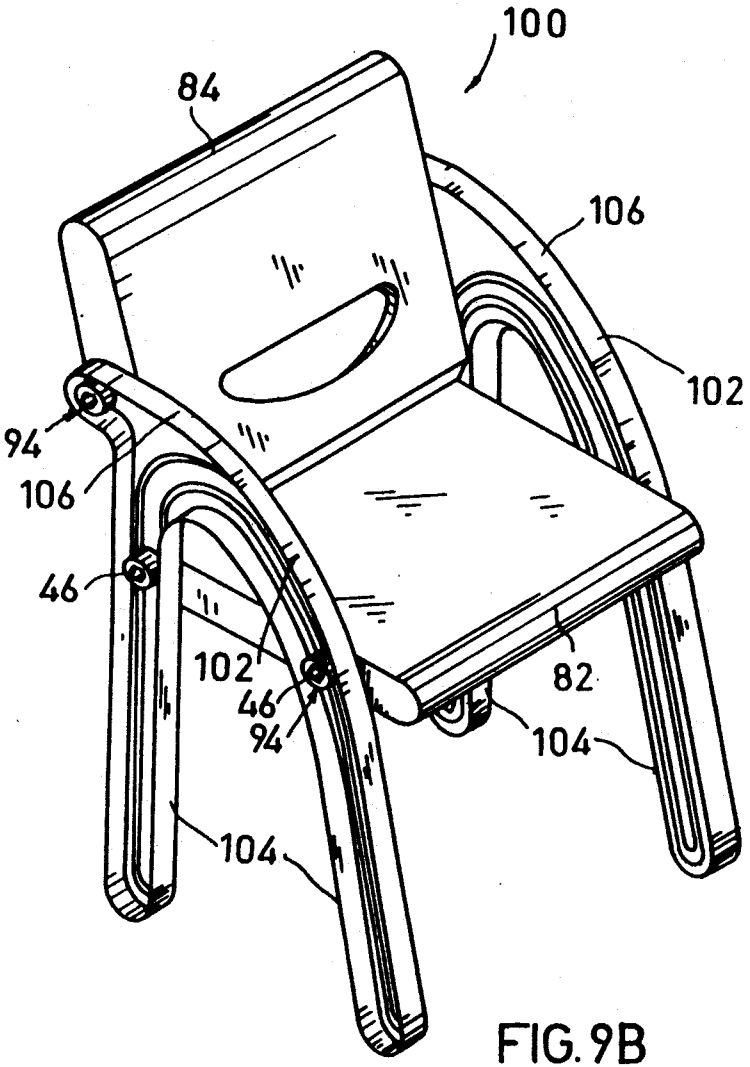
FIG. 9B is a view of the chair of FIG. 9A in a fully assembled state.
Figure 9A:
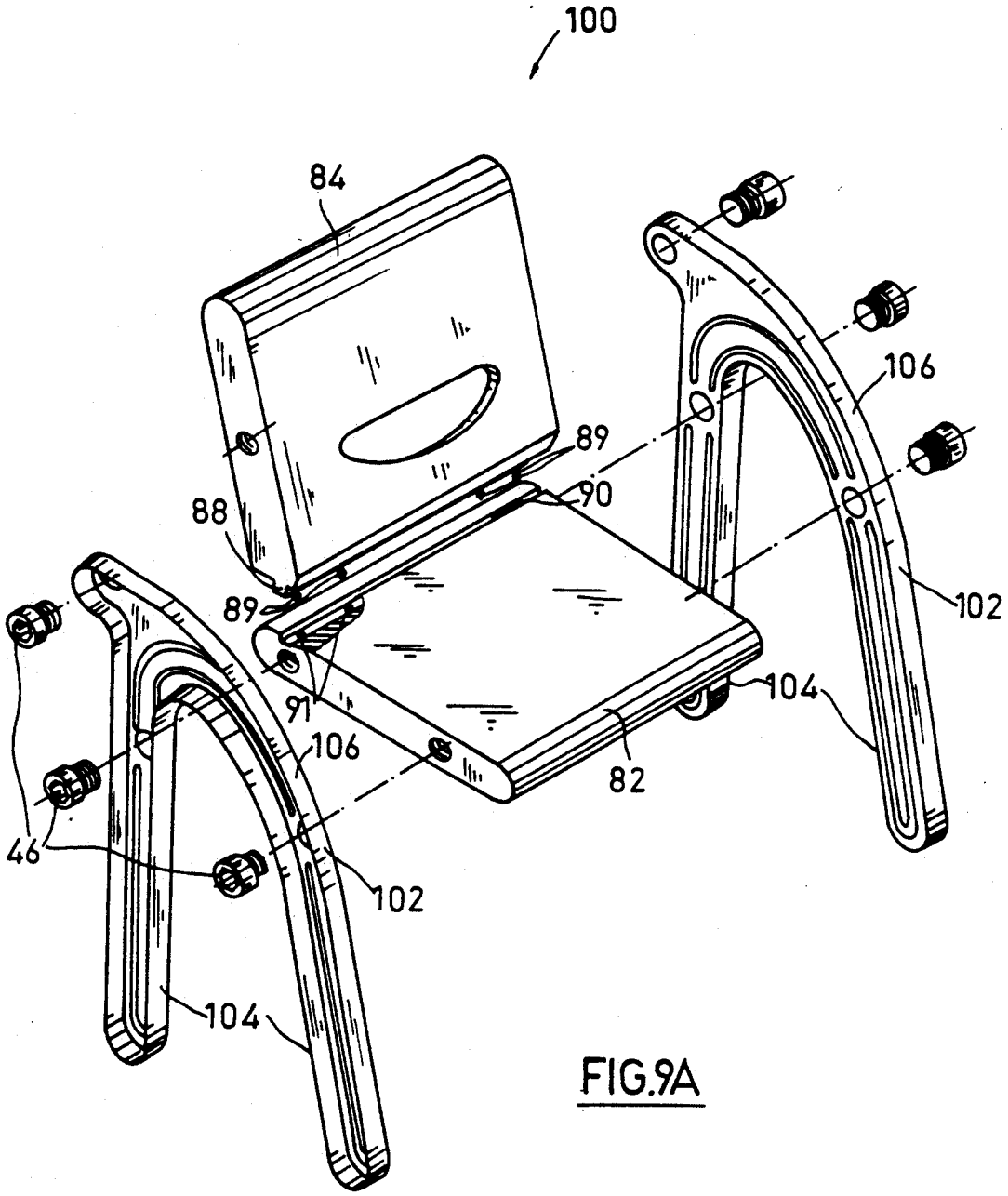
FIG. 9A is an exploded view of a chair constructed according to an alternative embodiment of the invention.

According to an alternative embodiment, similar to that shown in FIG. 9A, ridge 88 also has a plurality of protrusions arranged to engage a corresponding plurality of apertures formed in groove 90, so as to actually fasten the seat and back together, prior to the fastening thereto of the side supports 86.

Reference is now made to FIGS. 9A and 8B, which show a chair, referenced generally 100, constructed according to an alternative embodiment of the invention, prior to assembly and fully assembled. Also according to an embodiment of the invention, chair 100 is intended for use in combination with table 10 (FIG. 1).

Chair 100 includes seat 82 and back 84, substantially as described in conjunction with the embodiment of FIGS. 8A to 8C, with the exception that, according to the shown embodiment, ridge 88 also has a plurality of protrusions 89 (FIG. 9A) arranged to engage a corresponding plurality of apertures 91 formed in groove 90, so as to provide locking engagement of the seat and back.

There is also provided a pair of side supports 102 defining leg portions 104 and arm portions 106. The side supports, which also constitute a support framework for the seat and back, are connected to the seat and back at joints 94, as described above in conjunction with chair 80.

Referring also to the embodiment of FIGS. 8A and 8C, it will be appreciated that the provision of joints 94 renders both chair 80 (FIGS. 8A to 8C) and chair 100 (FIGS. 9A and 9B) particularly safe and sturdy, due to their load-spreading stepped construction, as described in conjunction with FIGS. 5A and 5B, and their attendant safety features, as described above in conjunction with FIGS. 5A to 6B, with relation to table 10.

Figure 10:
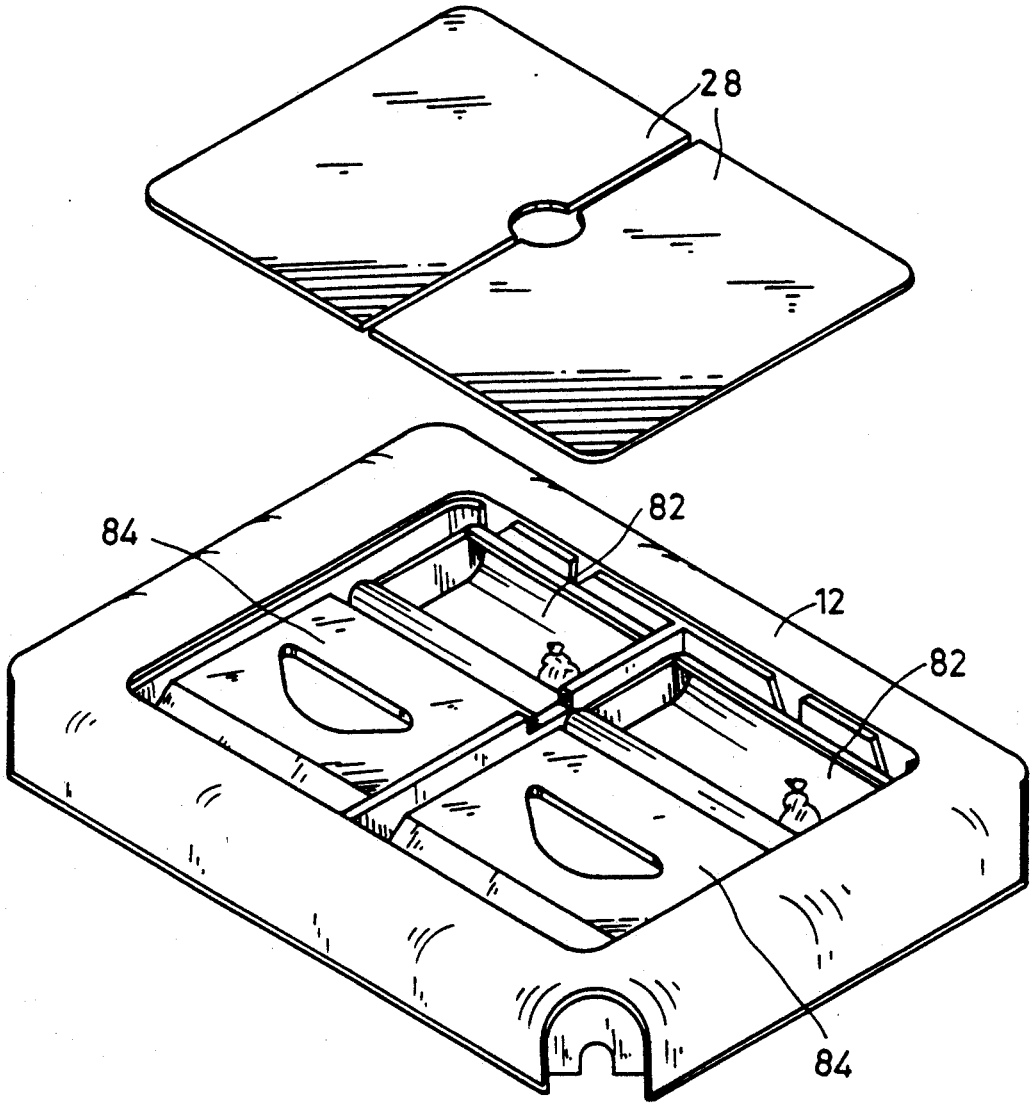
FIG. 10 is an illustration of a flat packing arrangement of the table and chair set of the present invention.

Reference is now made briefly to FIG. 10 which shows a flat packing arrangement, referenced generally 110, of work unit 10 (FIGS. 1 to 3) and of a pair of seat 82 and backs 84 of either of chairs 80 (FIGS. 8A to 8C) or 100 (FIGS. 9A and 9B), and of a number of packages, referenced 112, of fasteners, typically screws 46. In a commercial packaging utilizing the shown flat packing arrangement, the side supports of the chairs would typically not be enclosed within the work unit.

It will be appreciated by persons skilled in the art that the scope of the present invention is not limited by what has been shown and described above. The scope of the present invention is limited, rather, solely by the claims, which follow:

We claim:

1. A self-assembly furniture system including a self-assembly table comprising:

a generally planar table element having formed therein a plurality of first mating portions, wherein each of said plurality of first mating portions has at least one first rib formed on a first resilient surface thereof;

a plurality of legs each having a second mating portion formed thereon, wherein each of said second mating portions has formed on a second resilient surface thereof at least one second rib snappingly interlockable with said at least one first rib of a selected one of said plurality of first mating portions thereby to provide a snap fit connection arranged to prevent substantial relative movement between said first and second mating portions, and wherein said first and second mating portions define respective first and second apertures arranged along a common axis when said first and second mating portions are locked together, said table also including additional means for fastening together said first and second mating portions, said additional means comprising:

an elongated first fastening element arranged to extend axially through said first and second apertures; and a second fastening element arranged to be fastened together with said first fastening element so as to fasten therebetween said first and second mating portions.

2. A system according to claim 1 and wherein said first and second fastening elements are arranged for engagement over a first load bearing area substantially perpendicular to said common axis and said first and second fastening elements and predetermined portions of said first and second mating portions are arranged for engagement, at each of said plurality of joints, over a second load bearing area substantially at right angles to said common axis, said second load bearing area being larger than said first load bearing area.

3. A system according to claim 2, and wherein said first fastening element is a screw member and said second fastening element is a nut member, said screw member having a head portion defining at least two non-orthogonally arranged pairs of parallel grooves arranged to permit rotational engagement of said head portion of said screw member so as to cause tightening together of said screw member and said nut member, thereby locking together said first and second mating portions so as to substantially prevent relative rotation therebetween about said common axis.

4. A system according to claim 2, and wherein said first fastening element is a screw member and said second fastening element is a nut member, said screw member having a head portion defining a generally planar surface arranged to engage a corresponding planar surface of said first mating portion so as to be tightening thereagainst, one of said planar surfaces having at least one recess, the other of said planar surfaces having a protrusion arranged to engage said at least one recess when said screw member is tightened to a selected predetermined position.

5. A system according to claim 4, and wherein said protrusion defines a first sloped surface arranged to engage a corresponding first sloped face of said at least one recess when said screw is axially rotated in a first direction so as to be tightened against said planar surface of said first mating portion, and further defines a second sloped surface arranged to engage a corresponding second sloped face of said at least one recess when said screw is axially rotated in a second direction opposite to said first direction, said first sloped surface being arranged at a relatively small angle relative to said planar surfaces and said second sloped surface being arranged at a relatively large angle relative to said planar surfaces so as to require a greater rotational force to loosen said screw member than to tighten it.

6. A system according to claim 2, and wherein said table element is a generally rectangular table element having four corner portions and each of said first mating portions is arranged at one of said corner portions, said common axis of said first and second apertures having a predetermined nonparallel orientation to the edges of said table element so as to maximize stability of said table.

7. A system according to claim 1, and wherein said first fastening element is a screw member and said second fastening element is a nut member, said screw member having a head portion defining at least two nonorthogonally arranged pairs of parallel grooves arranged to permit rotational engagement of said head portion of said screw member so as to cause tightening together of said screw member and said nut member, thereby locking together said first and second mating portions so as to substantially prevent relative rotation therebetween about said common axis.

8. A system according to claim 1, and wherein said first fastening element is a screw member and said second fastening element is a nut member, said screw member having a head portion defining a generally planar surface arranged to engage a corresponding planar surface of a predetermined one of said first or second mating portions so as to be tightened thereagainst, one of said planar surfaces having formed thereon at least one recess, the other of said planar surfaces having formed thereon a protrusion arranged to engage said at least one recess when said screw member is tightened to a selected predetermined position, thereby to substantially prevent inadvertent loosening of said screw member and said nut member.

9. A system according to claim 8, and wherein said protrusion defines a first sloped surface arranged to engage a corresponding first sloped face of said at least one recess when said screw is axially rotated in a first direction so as to be tightened against said planar surface of a predetermined one of said first or second mating portions, and further defines a second sloped surface arranged to engage a corresponding second sloped face of said at least one recess when said screw is axially rotated in a second direction opposite to said first direction, said first sloped surface being arranged at a relatively small angle relative to said planar surfaces and said second sloped surface being arranged at a relatively large angle relative to said planar surfaces so as to require a greater rotational force to loosen said screw member than to tighten it.

10. A system according to claim 1, and also including a self-assembly chair comprising:

a seat member having a plurality of first apertures;

a pair of side members having a plurality of second aperture and arranged to support said seat member in a predetermined position relative thereto such that each of said first plurality of first apertures is secured in registration with a predetermined one of said plurality of second apertures along a common axis; and means for fastening said pair of side members together with said seat member so as to lock said seat member in said predetermined relative position, said means for fastening comprising:

a plurality of elongate first fastening elements, each being arranged to extend axially through a selected pair of corresponding first and second apertures, a plurality of second fastening elements, each being arranged to be fastened together with a selected first fastening element so as to lockably secure therebetween predetermined portions of said side members and said seat member in said predetermined position and thereby define a plurality of joints, said first and second fastening elements being arranged for engagement over a first load bearing area substantially perpendicular to said common axis and said first and second fastening elements and said predetermined portions of said side members and said seat member being arranged for engagement, at each of said plurality of joints, over a second load bearing area substantially at right angles to said common axis, said second load bearing area being of greater magnitude than said first load bearing area.

11. A system according to claim 10, and also including a back member defining a plurality of third apertures, said pair of side members being further arranged to support said back member in a predetermined position, transverse to said seat member, and such that each of said third apertures is arranged in registration with a predetermined one of said second apertures of said side members; each of a further plurality of said elongate first fastening elements being arranged to extend axially through a selected pair of corresponding second and third apertures, and each of a further plurality of second fastening elements being arranged to be fastened together with a selected first fastening element so as to lockably secure therebetween predetermined portions of said side members and said back member in said predetermined position relative to said seat member and thereby define a further plurality of joints, said first and second fastening elements being arranged for engagement over a first load bearing area substantially perpendicular to said common axis and said first and second fastening elements and said predetermined portions of said side members and said back member being arranged for engagement, at each of said plurality of joints, over a second load bearing area substantially at right angles to said common axis, said second load bearing area being of greater magnitude than said first load bearing area.

12. A system according to claim 10, and wherein said first fastening element is a screw member and said second fastening element is a nut member, said screw member having a head portion defining at least two non-orthogonally arranged pairs of parallel grooves arranged to be engaged so as to cause tightening together of said screw member and said nut member, thereby locking together said members disposed therebetween, so as to substantially prevent relative rotation therebetween about said common axis.

13. A system according to claim 12, and wherein each of said grooves defines a pair of surfaces lying in planes generally parallel to said axis.

14. A system according to claim 13, and wherein each of said grooves defines at least one open end arranged to communicate with an open end of an adjacent groove.

15. A system according to claim 13, and wherein each of said grooves defines a pair of open ends, each of which is arranged to communicate with one of the ends of an adjacent groove.

16. A system according to claim 13, and wherein said at least two non-orthogonally arranged pairs of parallel grooves comprise at least three pairs of parallel grooves arranged in a hexagonal arrangement.

17. A system according to claim 10, and wherein said first fastening element is a screw member and said second fastening element is a nut member, said screw member having a head portion defining a generally planar surface arranged to engage a corresponding planar surface of a predetermined portion of a selected one of said side members so as to be tightened thereagainst, one of said planar surfaces having at least one recess, the other of said planar surfaces having a protrusion arranged to engage said at least one recess when said screw member is tightened to a selected predetermined position.

18. A system according to claim 17, and wherein said protrusion defines a first sloped surface arranged to engage a corresponding first sloped face of said at least one recess when said screw is axially rotated in a first direction so as to be tightened against said planar surface of said predetermined portion of said side member, and further defines a second sloped surface arranged to engage a corresponding second sloped face of said at least one recess when said screw is axially rotated in a second direction opposite to said first direction, said first sloped surface being arranged at a relatively small angle relative to said planar surfaces and said second sloped surface being arranged at a relatively large angle relative to said planar surfaces so as to require a greater rotational force to loosen said screw member than to tighten it.

19. A system according to claim 10, and wherein said seat and back members are arranged such that an edge portion defined by one of said members is arranged for seating in a groove formed in a predetermined portion of the other of said members.

20. A system according to claim 19, and also including means formed integrally with said edge portion for lockably engaging said predetermined portion.

21. A system according to claim 20, and wherein said means for lockably engaging comprises a plurality of snap fasteners.

22. A system according to claim 1, and wherein said first fastening element is a screw member and said second fastening element is a nut member, said screw member having a head portion defining a generally planar surface arranged to engage a corresponding planar surface of said first mating portion so as to be tightened thereagainst, one of said planar surfaces having at least one recess, the other of said planar surfaces having a protrusion arranged to engage said at least one recess when said screw member is tightened to a selected predetermined position.

23. A system according to claim 22, and wherein said protrusion defines a first sloped surface arranged to engage a corresponding first sloped face of said at least one recess when said screw is axially rotated in a first direction so as to be tightened against said planar surface of said first mating portion, and further defines a second sloped surface arranged to engage a corresponding second sloped face of said at least one recess when said screw is axially rotated in a second direction opposite to said first direction, said first sloped surface being arranged at a relatively small angle relative to said planar surfaces and said second sloped surface being arranged to a relatively large angle relative to said planar surfaces so as to require a greater rotational force to loosen said screw member than to tighten it.

24. A system according to claim 1, and wherein said table element is a generally rectangular table element having four corner portions and each of said first mating portions is arranged at one of said corner portions, said common axis of said first and second apertures having a predetermined nonparallel orientation to the edges of said table element so as to maximize stability of said table.

25. A self-assembly furniture system including a self-assembly table comprising:

a generally planar table element having formed therein a plurality of first mating portions, wherein each of said plurality of first mating portions has at least one first rib formed on a first resilient surface thereof;

a plurality of legs each having a second mating portion formed thereon, wherein each of said second mating portions has formed on a second resilient surface thereof at least one second rib snappingly interlockable with said at least one first rib of a selected one of said plurality of first mating portions thereby to provide a snap fit connection arranged to prevent substantial relative movement between said first and second mating portions, and wherein said table element is made of a liquid impermeable material and defines at least two open, liquid retentive compartments each defining a base and sidewalls extending generally upwardly therefrom, and wherein said system also includes at least one generally rigid planar cover member for said at least two open compartments, said sidewalls also including means for supporting said cover member in at least one predetermined orientation transverse to said generally planar table element, wherein said means for supporting comprises at least one pair of notches defined in opposing sidewalls and defining at least one pair of parallel faces inclined at said predetermined orientation on which said cover member can recline.

26. A system according to claim 25, and wherein said at least one cover element defines a pair of parallel surfaces, at lest one of said parallel surfaces being formed as a surface with a predetermined form of usage.

27. A system according to claim 25, and wherein at least one of said at least two compartments is configured to contain at least one of a predetermined group of members in a packaging arrangement when said at least one cover member is in a closed position, said predetermined group of members comprising:

said seat member, and said back member.

* * * * *